United States Patent [19]

Kikuchi et al.

[11] 4,266,377

[45] May 12, 1981

[54] TAILSTOCK DEVICE

[75] Inventors: Makoto Kikuchi, Kariya; Ikuo Ohtsu, Toyota, both of Japan

[73] Assignee: Toyoda-Koki Kabushiki Kaisha, Kariya, Japan

[21] Appl. No.: 77,591

[22] Filed: Sep. 21, 1979

[30] Foreign Application Priority Data

Sep. 22, 1978 [JP] Japan ..... 53-116817

[51] Int. Cl.[3] ..... B24B 53/00

[52] U.S. Cl. ..... 51/262 T; 51/237 R; 51/259; 82/15; 82/31

[58] Field of Search ..... 51/263, 237 R, 259, 51/262 T; 82/15, 31

[56] References Cited

U.S. PATENT DOCUMENTS

| | | | |
|---|---|---|---|
| 2,526,844 | 10/1950 | Boggis | 51/237 B |
| 2,954,651 | 10/1960 | Gebhart | 51/236 |
| 3,192,675 | 7/1965 | Fries | 51/165 |
| 3,896,594 | 7/1975 | Sakai | 51/236 |

FOREIGN PATENT DOCUMENTS

| | | | |
|---|---|---|---|
| 1223322 | 2/1971 | United Kingdom | 51/236 |

*Primary Examiner*—Harold D. Whitehead

*Attorney, Agent, or Firm*—Oblon, Fisher, Spivak, McClelland & Maier

[57] ABSTRACT

A tailstock device for a grinding machine including a pilot shaft rotatably and axially movably supported by a tailstock base, a tailstock body fixedly supported on the pilot shaft, a center carried on the tailstock body in parallel relationship with and upwardly of the pilot shaft for supporting one end of a workpiece to be ground by a grinding wheel, a spring member for urging the pilot shaft and the center toward the workpiece, a dressing tool adjustably supported on the tailstock body at the rear of the center to be movable in a direction perpendicular to the axis of the center for dressing the grinding wheel, a mechanism for adjusting the position of the dressing tool so as to bring the tip of the dressing tool into a position corresponding to the finish surface of the workpiece, and a taper adjusting mechanism for adjustably swinging the tailstock body about the pilot shaft to adjust the angular position of the center.

5 Claims, 8 Drawing Figures

TAILSTOCK DEVICE

BACKGROUND OF THE INVENTION

1. Field of the Invention

The present invention relates to a tailstock device provided with a dressing device for a grinding machine.

2. Description of the Prior Art

Conventionally, the dressing tool is mounted on the side of the tailstock device secured on the table of the grinding machine. In order to dress the grinding wheel, the table mounting the tailstock device thereon is longitudinally traversed. Since the dressing tool is moved by utilizing traversing movement of the table, this arrangement is effective particularly in a super-precision grinding operation required for high cylindricity.

On the other hand, there is a limitation in mounting and adjusting the dressing tool. More specifically, it is impossible to adjust the tip of the dressing tool into a position corresponding to the finished surface of the workpiece because of the existence of the ram provided on the tailstock device for advancing and retracting the center. Accordingly, in case of dead stop grinding wherein the wheel movement toward the workpiece is stopped at the dead stop position to finish the workpiece, the grinding wheel at such dead stop position is spaced apart from the dressing position. As a result, after the dressing operation, the difference between the dead stop position and the dressing position of the grinding wheel must be compensated for in order to initiate the dead stop grinding. This compensation may cause a positioning error of the grinding wheel, which results in lowering the accuracy of the workpiece.

SUMMARY OF THE INVENTION

It is an object of the present invention to provide a new and improved tailstock device with a dressing tool whose tip is adjustable into a position corresponding to a finished size surface of a workpiece to be ground.

Another object of the present invention is to provide a new and improved tailstock device of the character set forth above wherein a tailstock body mounting thereon a center and the dressing tool is supported by a pilot shaft and is adjustably swung about the center of the pilot shaft by a taper adjusting mechanism to adjust the angular position of the center.

Briefly, according to the present invention, these and other objects are achieved by providing a tailstock device for a grinding machine, as mentioned below. A pilot shaft is supported by support portions provided at opposite ends of a tailstock base. A tailstock body is supported on the pilot shaft between the support portions so as to be movable in a direction along the axis of the pilot shaft and to be rotatable about the axis of the pilot shaft. A center is carried by the tailstock body in parallel relationship with and upwardly of the pilot shaft for supporting one end of a workpiece to be ground by a grinding wheel. A spring member urges the tailstock body and the center toward the workpiece. A dressing housing is supported on the tailstock body at the rear of the center. A dressing tool is adjustably supported by the dressing housing to be movable in a direction perpendicular to the axis of the center for dressing the grinding wheel. A mechanism is provided to adjust the position of the dressing tool so as to bring the tip of the dressing tool into a position corresponding to the finished surface of the workpiece. A taper adjusting mechanism is provided to adjustably swing the tailstock body about the pilot shaft so as to adjust the angular position of the center.

BRIEF DESCRIPTION OF THE DRAWINGS

The foregoing and other objects and many of the attendant advantages of the present invention will be readily appreciated as the same becomes better understood by reference to the following detailed description, when considered in connection with the accompanying drawings, in which.

DETAILED DESCRIPTION OF THE PREFERRED EMBODIMENT

Figure 1:
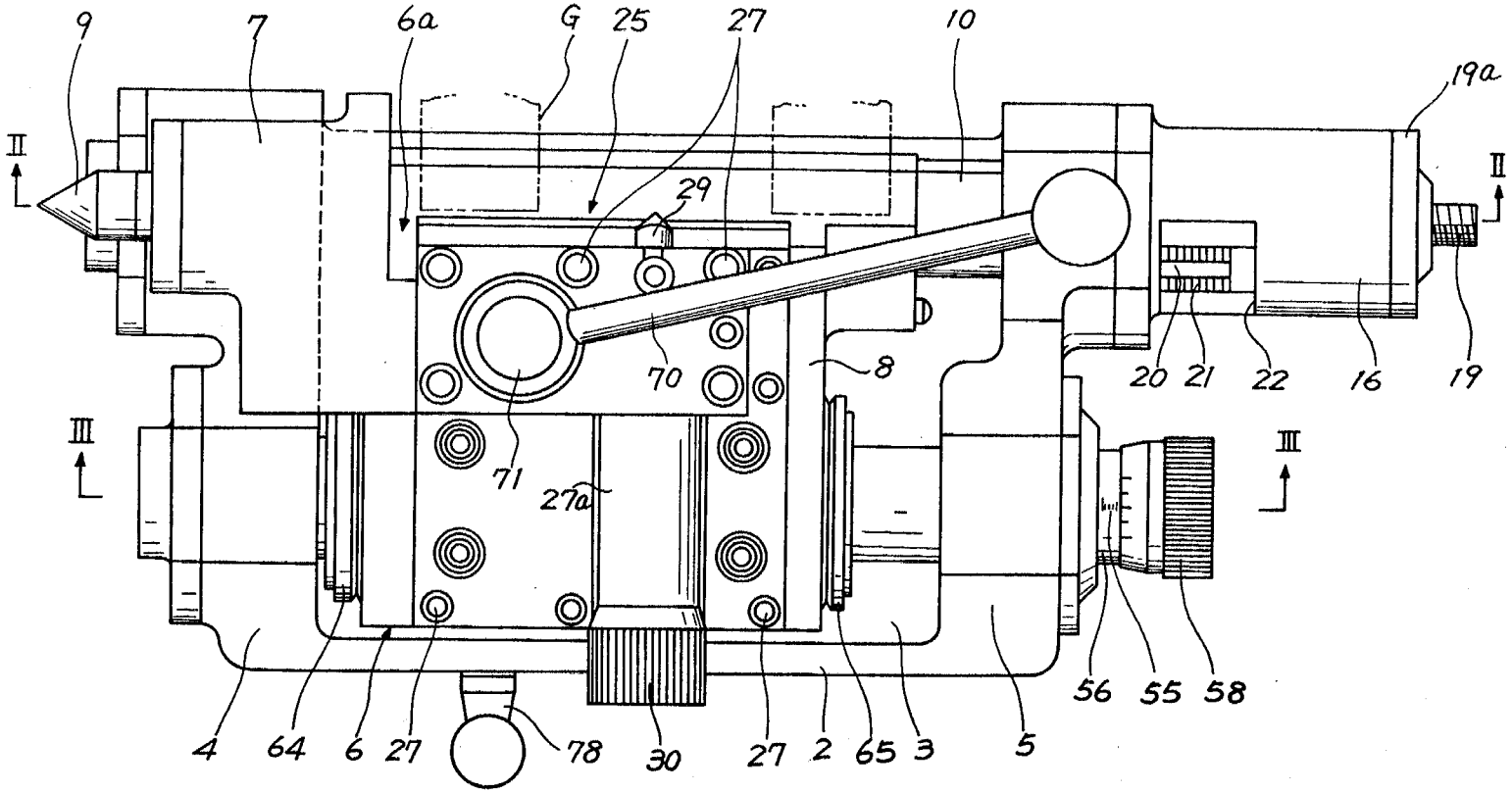
FIG. 1 is a plan view of a tailstock device according to the present invention.
Figure 2:
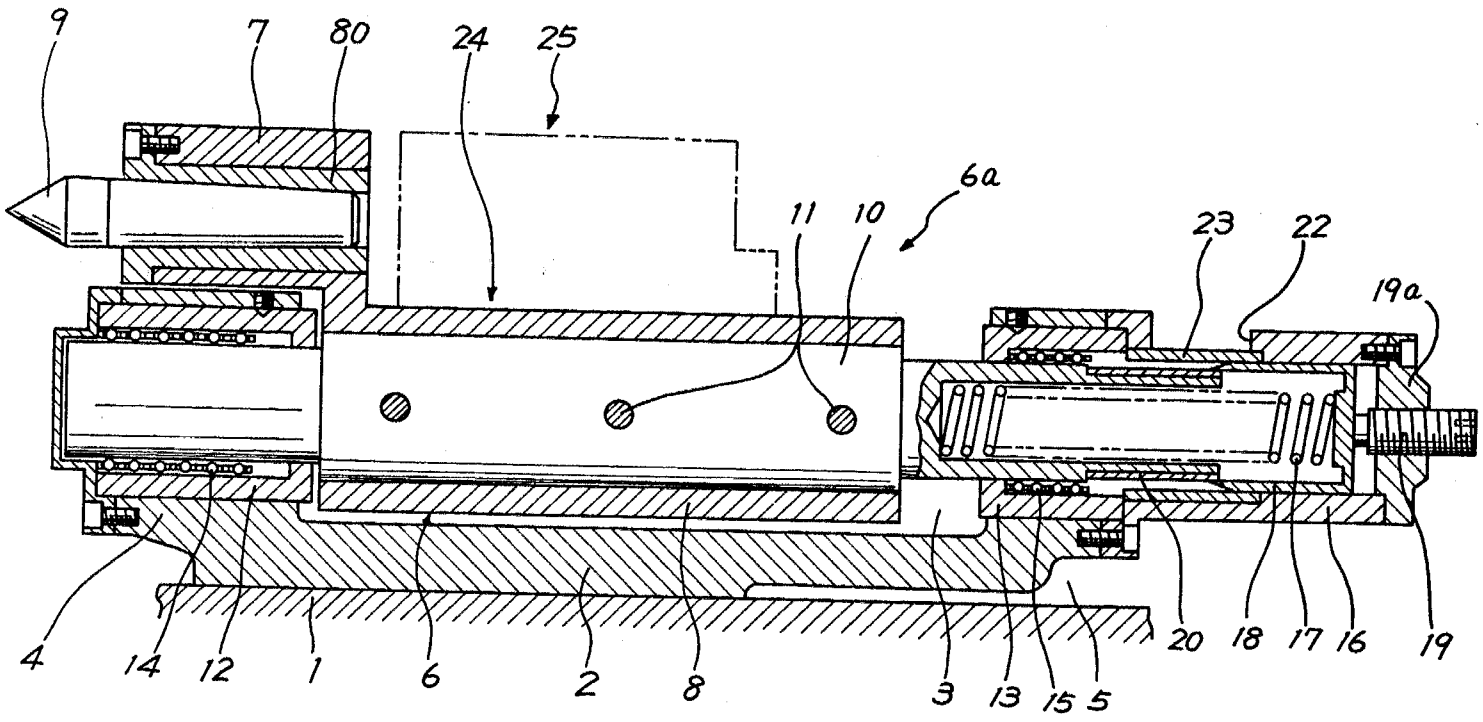
FIG. 2 is a sectional view taken along the lines II—II in FIG. 1.

Referring now to the drawings, wherein like reference numerals or characters refer to identical or corresponding parts through the several views, and more particularly to FIGS. 1 and 2, there is shown a longitudinally movable table 1 of a grinding machine on which a tailstock base 2 is mounted. The tailstock base 2 is provided at its longitudinally opposite ends with support portions 4 and 5 to form a concave or recessed portion 3 therebetween to receive a tailstock body 6. The tailstock body 6 comprises a center receiving portion 7 and a base portion 8. A center 9 is supported by the center receiving portion 7 through a support bushing 80. A pilot shaft 10 is inserted in the base portion 8 in parallel relationship with and downwardly of the center 9 in the vertical direction and is fixedly secured thereto by tightening bolts 11. The opposite ends of the pilot shaft 10 are rotatably and axially movably supported by the support portions 4 and 5 through bushings 12, 13 and stroke bearings 14, 15, respectively. As a result, the tailstock body 6 is movable along and rotatable about the axis of the pilot shaft 10 within the recessed portion 3.

A hollow cylindrical member 16 is secured to the side wall of the support portion 5. A sleeve member 18 is slidably received in the cylindrical member 16. A compression spring 17 is interposed between the sleeve member 18 and the dead end of a blind bore formed on one end of the pilot shaft 10. An adjusting screw 19 is threaded into an end plate 19*a* secured to the cylindrical member 16 and is held in abutting contact with the sleeve member 18 for adjusting the compression force of the spring 17. By adjusting the screw 19, the sleeve member 18 is moved relative to a graduation ring 20 fixedly secured on one end of the pilot shaft 10 so as to thereby indicate the force of the spring 17 by means of graduations 21 marked on the ring 20. The cylindrical member 16 is formed with a cut-out 22 so that the graduations 21 can be read. Reference numeral 23 denotes a cylindrical cover made of transparent plastic.

Figure 4:
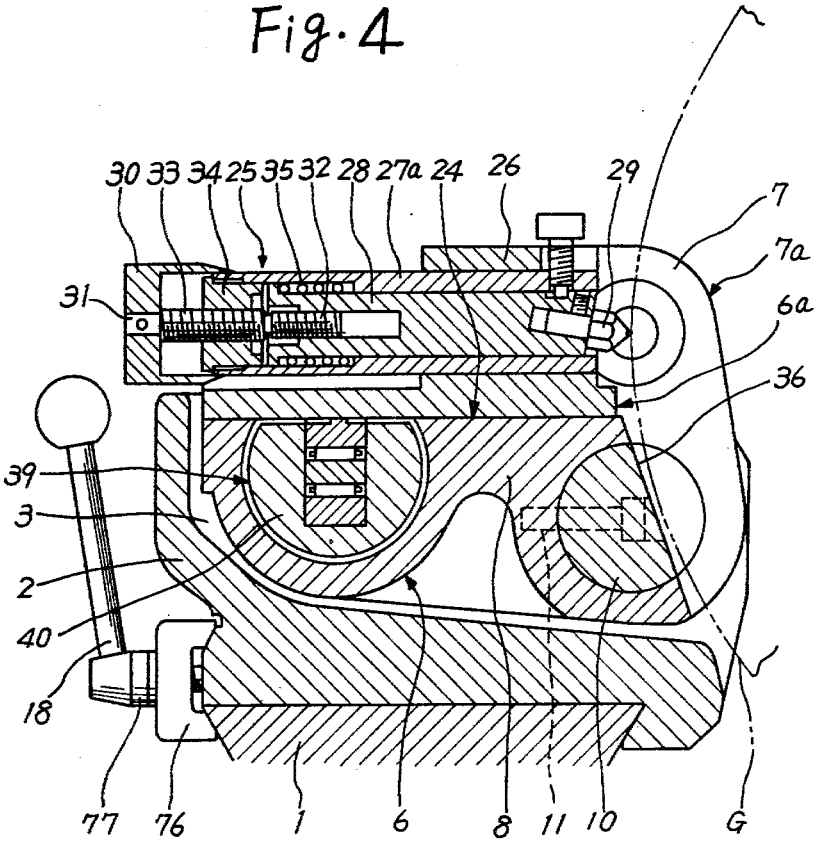
FIG. 4 is a sectional view taken along the lines IV—IV in FIG. 3.

The tailstock body 6 is formed with a space 6a at the rear of the center receiving portion 7 so as to permit a grinding wheel G to enter thereinto toward the axis of the center 9. As shown in FIG. 4, the tailstock body 6 is formed at its top with a mounting surface 24 for mounting thereon a dressing device 25 to dress the grinding wheel G. A dressing housing 26 is secured on the mounting surface 24 by means of bolts 27. A guide sleeve 27a is fitted within the dressing housing 26 and supports a holder 28 so as to be slidable in a direction perpendicular to the axis of the center 9. A dressing tool 29 is secured to one end of the holder 28 while reference numeral 30 denotes an adjusting knob for adjusting the position of the dressing tool 29. An adjusting screw shaft 31 is fixed to the knob 30 and has two threaded portions 32 and 33 with different pitches. The threaded portion 32 is engaged with the holder 28 while the other threaded portion 33 is engaged with a nut 34 which is threadedly secured to the guide sleeve 27a. A compression spring 35 is interposed between the guide sleeve 27a and the holder 28 to eliminate backlash in the differential screw. The pilot shaft 10 is formed at the right side, as viewed in FIG. 4, with a notched portion 36 so as to prevent interference with the grinding wheel G entering into the space 6a.

Figure 3:
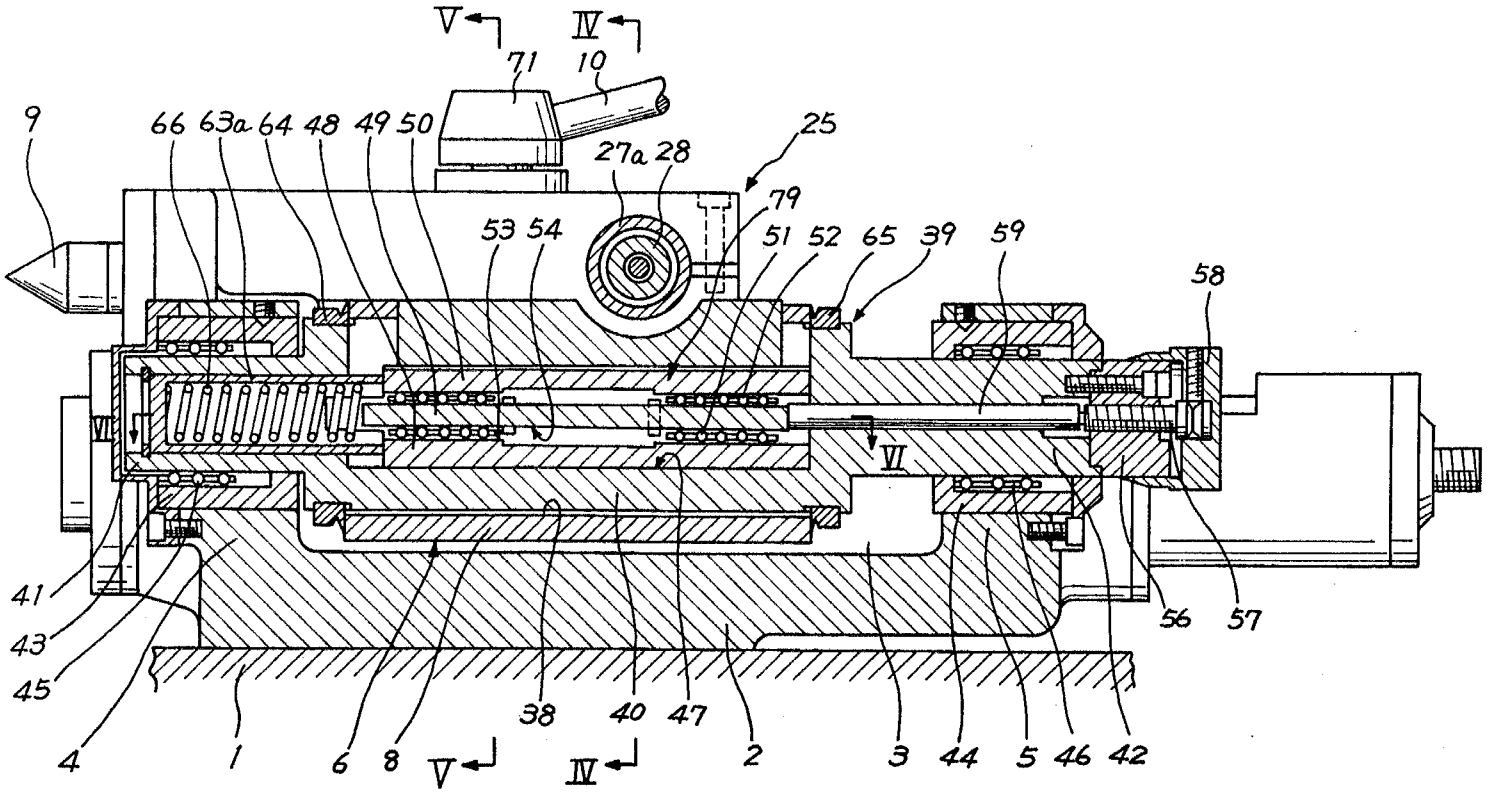
FIG. 3 is a sectional view taken along the lines III—III in FIG. 1.
Figure 5:
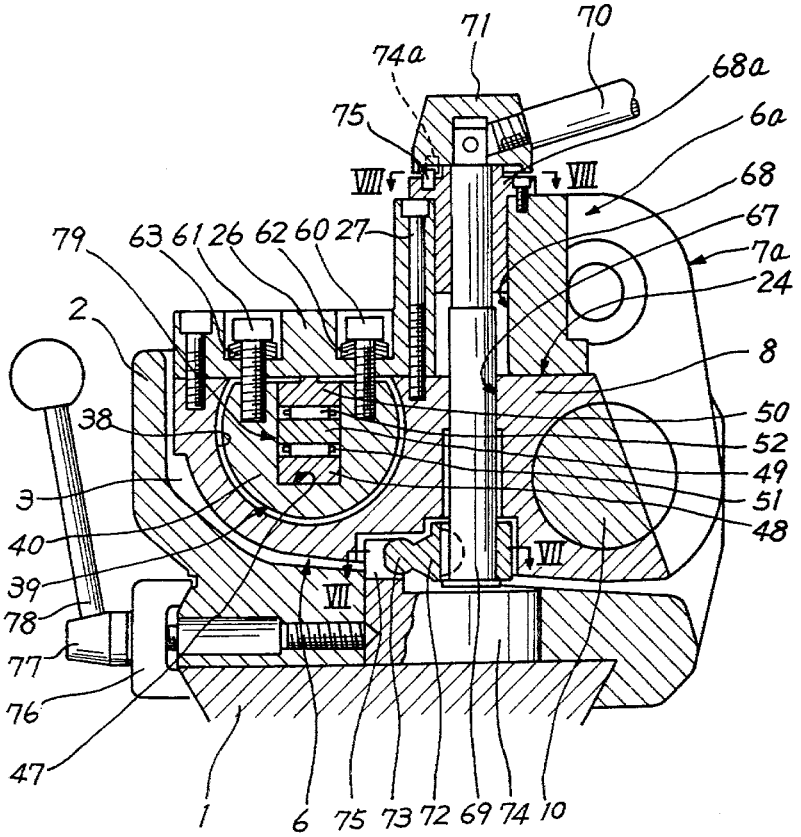
FIG. 5 is a sectional view taken along the lines V—V in FIG. 3.

As shown in FIGS. 3 and 5, the tailstock body 6 is formed with a through bore 38 into which a support shaft 39 is received with a small clearance therebetween in parallel relationship with the pilot shaft 10. The support shaft 39 has at its axial middle a semi-circular portion 40 with the flat surface being formed at the top and at its axial opposite ends circular shaft portions 41 and 42, which are respectively rotatably and axially movably supported by the support portions 4 and 5 through bushings 43, 44 and stroke bearings 45, 46. On the flat surface of the semi-circular portion 40 is formed an axially extending slot 47 into which a taper adjusting device 79 is incorporated.

The taper adjusting device 79 comprises a taper member 48 received in the bottom of the slot 47, a slider member 49 slidably mounted on the taper member 48 through needle bearings 51 and a push-up member 50 slidably mounted on the slider member 49 through needle bearings 52. The top surface of the taper member 48 and the underside of the slider member 49 are tapered upwardly and downwardly toward the left, respectively, as viewed in FIG. 3. Accordingly, when the slider member 49 is moved to the left relative to the taper member 48, as viewed in FIG. 3, the push-up member 50 is moved upwardly. The support shaft 39 has secured at one end thereof a graduation ring 56, on the outer periphery of which graduations 55 are marked. An adjusting screw 57 is threaded into the graduation ring 56. A knob 58 is rotatably supported on the ring 56 and is fixedly connected to the adjusting screw 57. Rotation of the knob 58 and the adjusting screw 57 causes axial movement of the slider member 49 through an intermediate shaft 59 which is slidably received in the circular shaft portion 42 of the support shaft 39.

Figure 6:
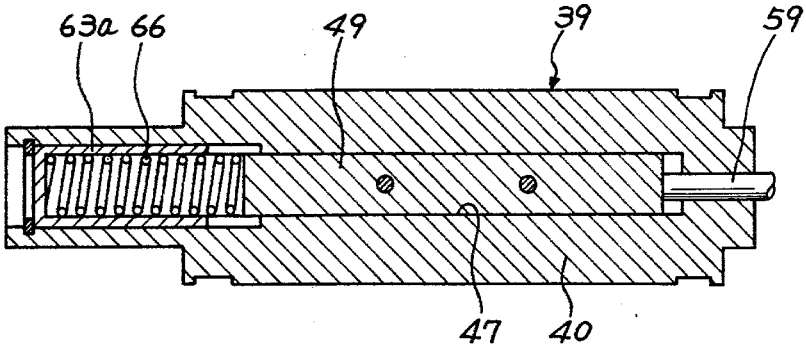
FIG. 6 is a sectional view taken along the lines VI—VI in FIG. 3.

As shown in FIG. 5, a plurality of bolts 60 and 61 are screwed into the top surface of the semi-circular portion 40 of the support shaft 39 through the dressing housing 26. Washer springs 62, 63 are interposed between the bolts 60, 61 and the dressing housing 26 so as to maintain contact between the underside of the dressing housing 26 and the push-up member 50. Referring now to FIG. 3, a restricting member 63a is held in position within the circular portion 41 of the support shaft 39 so as to restrict the axial movement of the taper member 48 and the push-up member 50. V-shaped rings 64 and 65 are respectively mounted on the circular portions 41 and 42 of the support shaft 39 to prevent coolant fluid or chips from entering into the semi-circular portion 40 of the support shaft 39. As shown in FIG. 6, a compression spring 66 is interposed between the restricting member 63a and the slider member 49 so as to maintain contact between the slider member 49 and the intermediate shaft 59.

Figure 7:
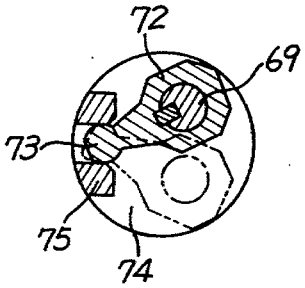
FIG. 7 is a sectional view taken along the lines VII—VII in FIG. 5.

As also shown in FIG. 5, the tailstock body 6 and the dressing housing 26 are respectively provided with vertical bores 67 and 68 in coaxial alignment with each other. An end cover 68a is fixedly inserted into the bore 68 of the dressing housing 26. A rotary shaft 69 is rotatably supported by the end cover 68a and the bore 67 of the tailstock body 6 while a cap member 71 having a manipulating lever 70 is secured to the upper end of the rotary shaft 69. A swing member 72 is keyed to the lower end of the rotary shaft 69 and, as depicted in FIG. 7, the swing member 72 is provided at an end portion thereof with a spherical portion 73 which is engaged with a bifurcated portion 75 of a stationary block 74 securedly inserted into the tailstock base 2 so as to be prevented from movement in the axial direction of the center 9. Accordingly, when the rotary shaft 69 is operated by the manipulating lever 70, the swing member 72 is swung due to the reaction about the spherical portion 73, thereby shifting the rotary shaft 69 and the tailstock body 6 in the axial direction of the center 9.

Figure 8:
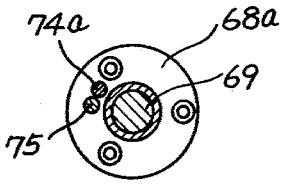
FIG. 8 is a sectional view taken along the lines VIII—VIII in FIG. 5.

As shown in FIG. 8, a stop pin 74a is embedded into the underside of the cap member 71. The stop pin 74a is adapted to abut with a stationary pin 75 projected from the end cover 68a so as to restrict the return end of the manipulating lever 70 or the forward movement end of the center 9. Reference numeral 76 denotes a clamp plate for clamping the tailstock base 2 in position against the table 1 and the clamp plate 76 is clamped by a clamp bolt 77 and a lever 78.

In operation, in order to hold a workpiece between the centers, the rotary shaft 69 is rotated by manipulating the lever 70, thereby swinging the swing member 72 about the spherical portion 73. As a result, the rotary shaft 69 is shifted in the axial direction of the center 9 so that the tailstock body 6 and the center 9 are retracted. Thereafter, the workpiece to be held is aligned with the axis of the center 9 and the manipulating lever 70 of the rotary shaft 69 is then rotated in the reverse direction so that the tailstock body 6 and the center 9 are advanced to support the workpiece. When the adjusting screw 19 is rotated to move the sleeve member 18 in the axial direction, an appropriate applying force corresponding to the length of the workpiece is exerted on the workpiece.

In order to dress the grinding wheel G, the adjusting screw shaft 31 is rotated by manipulating the knob 30 to move the holder 28 in the axial direction so as to align the tip of the dressing tool 29 with the surface of the finished size of the workpiece. Subsequently, the grinding wheel G is transversely moved by a feed device (not shown) into a position where the grinding wheel G can be dressed a dressing amount by the dressing tool 29. At this time, the grinding wheel G is located in the space 6a. Since the pilot shaft 10 is formed with the notched portion 36, the grinding wheel G in the space 6a does not interfere with the pilot shaft 10. Thereafter, the tailstock base 2 and the tailstock body 6 are moved to a traverse cylinder (not shown) in the axial direction of the center 9, whereby the grinding wheel G is dressed by the dressing tool 29. Since the tip of the dressing tool 29 is aligned with the surface of the finish size of the workpiece, the periphery of the grinding wheel G having been dressed corresponds with the surface of the finish size of the workpiece. Accordingly, grinding operation on the workpiece is controlled by using this dressing position of the grinding wheel G as an advanced dead-stop position.

With the dressing operation on the grinding wheel G being completed, the grinding wheel G is transversely retracted by the feed device, and the tailstock base 2 and the tailstock body 6 are moved by the traverse cylinder in the axial direction of the center 9 so as to oppose the workpiece with the grinding wheel G. The grinding wheel G is again advanced in the transverse direction by the feed device to perform a grinding operation on the workpiece. When the grinding wheel G is advanced into its dead-stop position, the workpiece is ground to the finished size. Accordingly, there is no need for compensating for the position of the grinding wheel G after the dressing operation with result of high accuracy of the finished workpiece. Since there is no interfering component within the path of travel of the dressing tool 29, it is possible to retract the dressing tool 29 to a position adjacent to and in the direction perpendicular to the axis of the center 9 to thereby dress the grinding wheel G for any range of finished size of the workpiece.

In order to perform a tapering adjustment, the adjusting screw 57 is rotated by manipulating the knob 58, while observing the graduations 55 on the graduation ring 56, so as to advance the slider member 49 through the intermediate shaft 59. Accordingly, the push-up member 50 is moved upward through the wedge action between the taper member 48 and the slider member 49 so that the dressing housing 26 and the tailstock body 6 are swung about the pilot shaft 10 against the washer springs 62 and 63, with the result of adjustment of the angular position of the center 9.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A tailstock device for a grinding machine to grind workpiece in a dead stop grinding mode comprising:

a tailstock base provided with support portions at opposite ends thereof;

a pilot shaft supported by said support portions;

a tailstock body supported on said pilot shaft between said support portions so as to be movable in a horizontal direction of the axis of said pilot shaft and to be rotatable about the axis of said pilot shaft;

a center carried by said tailstock body in parallel relationship with and upwardly of said pilot shaft for supporting one end of a workpiece to be ground by a grinding wheel;

a spring member for urging said tailstock body and said center toward said workpiece;

a dressing housing supported on said tailstock body at the rear of said center;

a dressing tool adjustably supported by said dressing housing to be movable in a horizontal direction perpendicular to the axis of said center for dressing said grinding wheel;

the tip of said dressing tool being in a horizontal plane which includes the axis of said center;

means for adjustably positioning said dressing tool so as to bring the tip of said dressing tool into a position corresponding to the finished surface of said workpiece;

said pilot shaft being formed with a notched portion thereon so as to permit the periphery of said grinding wheel to move into a position corresponding to the axis of said center in a dressing operation; and taper adjusting means for adjustably swinging said tailstock body about the axis of said pilot shaft to adjust the angular position of said center.

2. A tailstock device as claimed in claim 1, wherein said pilot shaft is rotatably and axially movably supported by said support portions, and said tailstock body is fixedly supported on said pilot shaft.

3. A tailstock device as claimed in claim 1, further comprising means for adjusting the force of said spring member.

4. A tailstock device as claimed in claim 1, further comprising:

a vertical rotary shaft rotatably supported by said dressing housing and said tailstock body;

a cap member secured to one upper end of said rotary shaft;

a manually operated lever secured to said cap member; and a swing member connected at one end thereof with the other lower end of said rotary shaft, the other end of said swing member being received in said tailstock base in such a manner as to be prevented from movement in the direction parallel to the axis of said pilot shaft.

5. A tailstock device as claimed in claim 1 or 4, said taper adjusting means comprising:

a support shaft slidably and rotatably supported at opposite ends thereof by said support portions of said tailstock base and received at a middle portion thereof in said tailstock body with a clearance in parallel relationship with said pilot shaft, said support shaft being formed with an axially extending slot at said middle portion;

a taper member received in the bottom of said slot and restrained from axial movement relative thereto;

a slider member slidably mounted on said taper member in tapered relationship therewith in said slot;

a push-up member slidably mounted on said slider member in said slot, restrained from axial movement relative to said support shaft and held in contact engagement with said dressing housing; and means for axially moving said slider member relative to said taper member so as to vertically move said push-up member.

* * * * *